US005692439A

United States Patent [19]

Wech

[11] Patent Number: 5,692,439

[45] Date of Patent: Dec. 2, 1997

[54] PRINTING UNIT FOR BLANKET-TO-BLANKET PRINTING

[75] Inventor: Erich Wech, Augsburg, Germany

[73] Assignee: MAN Roland Druckmaschinen AG, Offenbach am Main, Germany

[21] Appl. No.: 430,241

[22] Filed: Apr. 28, 1995

[30] Foreign Application Priority Data

May 4, 1994 [DE] Germany ..... 44 15 711.8

[51] Int. Cl.[6] ..... B41F 5/04

[52] U.S. Cl. ..... 101/220; 101/179

[58] Field of Search ..... 101/220, 221, 101/222, 223, 224, 225, 375, 219, 216, 177, 174, 176, 179, 180, 230, 231

[56] References Cited

U.S. PATENT DOCUMENTS

| | | | |
|---|---|---|---|
| 2,986,085 | 5/1961 | Johnson . | |
| 3,166,012 | 1/1965 | Hantscho . | |
| 3,177,804 | 4/1965 | Koch | 101/180 |
| 3,616,751 | 11/1971 | Moway | 101/179 |
| 4,000,691 | 1/1977 | Fischer | 101/177 |
| 4,074,626 | 2/1978 | Werner | 101/221 |
| 4,144,813 | 3/1979 | Julian | 101/375 |
| 4,563,950 | 1/1986 | Fischer | 101/219 |
| 4,598,640 | 7/1986 | Nawrath | 101/180 |
| 5,012,735 | 5/1991 | Fischer | 101/177 |
| 5,440,981 | 8/1995 | Vrotacoe et al. | 101/375 |

FOREIGN PATENT DOCUMENTS

| | | | |
|---|---|---|---|
| 0131813 | 1/1985 | European Pat. Off. . | |
| 0235677 | 9/1987 | European Pat. Off. . | |
| 0277545 | 8/1988 | European Pat. Off. . | |
| 0514344 | 11/1992 | European Pat. Off. . | |
| 203612 | 11/1907 | Germany . | |
| 2235844 | 1/1974 | Germany . | |
| 2754429 | 6/1979 | Germany . | |
| 0137829 | 9/1979 | Germany | 101/180 |
| 3543704 | 6/1987 | Germany . | |
| 4320923 | 1/1994 | Germany . | |
| 4307320 | 7/1994 | Germany . | |
| 58-171958 | 8/1983 | Japan . | |
| 58-16014 | 10/1983 | Japan . | |
| 3-37978 | 8/1991 | Japan . | |
| 4-58335 | 5/1992 | Japan . | |
| 5-74838 | 10/1993 | Japan . | |
| 5-301483 | 11/1993 | Japan . | |
| 363359 | 9/1962 | Switzerland . | |
| 843899 | 8/1960 | United Kingdom . | |
| 2122945 | 1/1984 | United Kingdom | 101/180 |

OTHER PUBLICATIONS

Offsettechnik, Technologie in der Druckindustrie by Helmut Teschner, copyright 1982, p. 271.

*Primary Examiner*—Eugene H. Eickholt
*Attorney, Agent, or Firm*—Cohen, Pontani, Lieberman & Pavane

[57] ABSTRACT

The present invention relates to a printing unit for blanket-to-blanket printing. The printing unit includes two printing couples positioned one on top of the other. Each printing couple includes a form cylinder and a transfer cylinder. The transfer cylinders each carry a gap-free blanket. A horizontal web passes between the transfer cylinders of the two printing couples. In order to achieve good print quality with an advantageous web path, a plane connecting the centers of the transfer cylinders is inclined from a plane extending perpendicular to the web and passing through the center of one of the transfer cylinders by an angle (α) in the range from 0° to 10° and optimally by an angle of 5°.

7 Claims, 4 Drawing Sheets

PRINTING UNIT FOR BLANKET-TO-BLANKET PRINTING

BACKGROUND OF THE INVENTION

1. Field of the Invention

The present invention relates to a printing machine for blanket-to-blanket printing having a horizontal web path and, more particularly, to a printing unit having printing couples arranged one above the other with transfer cylinders having gap-free blankets and wherein a plane connecting the center of each of the transfer cylinders of the printing couples lies at an angle to the vertical.

2. Description of the Prior Art

A printing unit for blanket-to-blanket printing having a horizontal web path is disclosed in German Patent No. DE 27 54 429 C2. In the printing unit described by this patent, two printing couples, each having a plate cylinder and a transfer cylinder, are arranged one above the other. The web being printed, which runs horizontally thereto, is passed between the transfer cylinders. The plane extending between the center of each of the transfer cylinders is inclined from the vertical by a relatively large angle of approximately 30°. The vertical being a line extending substantially perpendicular to the web. This measure ensures that the transfer cylinders are contacted by the web at an angle to the plane extending between the centers of the cylinders. Such an angle is necessary because the transfer cylinders have clamping channels. Given a vertical arrangement of cylinders of this type, one directly above the other, the pressure on the web would be interrupted as the clamping channels pass through the printing zone. The web tension and web constraint exercised by the printing unit would also be interrupted at this point. However, positioning the transfer cylinders at an incline of such magnitude as disclosed in this German Patent provides numerous disadvantages when printing. One such disadvantage is that the rotational speed of the transfer cylinders in the area of angular contact is greater than the web speed. This causes movement between the web and the transfer cylinders which has a negative impact on the print quality. Furthermore, the greater rotational speed of the transfer cylinders results from the larger radius of these cylinders as compared to the radius of the printing zone.

German Patent No. DE-PS 35 43 704 discloses a printing unit in which the rubber blanket sleeves are changed while the cylinders remain in the printing unit and are being suspended on one side.

It is thus desirable to produce a printing unit for blanket-to-blanket printing which does not interrupt the pressure on the web as the clamping channels pass through the printing zone, but wherein the rotational speed of the transfer cylinders is not greater than the web speed in the area of angular contact. This printing unit should also allow for changing the rubber blanket sleeves of the transfer cylinders without removing the cylinders.

SUMMARY OF THE INVENTION

The printing unit of the present invention includes two printing couples. Each printing couple includes a form cylinder and a transfer cylinder. The printing couples are positioned one above the other with the transfer cylinders of each couple being in contact with each other. Passing between the transfer cylinders is a horizontal web. The transfer cylinders are positioned such that a plane connecting the center or axis of each of the transfer cylinders of the printing couples is inclined by an angle between 0° and 10° from the vertical corresponding to the plumb. This angling of the plane connecting the centers of the printing couples reduces the angular-contact area of the transfer cylinders. This in turn reduces the movement between the web and the cylinder surface and thus improves the print quality. Ideally, from this point of view, the angular contact should be dispensed with entirely. However, in actuality, removing the angular contact is disadvantageous. If there is no angular contact, the web would always continue to adhere to the cylinder with the larger printing share of the subject at the moment after leaving the printing gap. The web would thus wobble, depending on the printing share of the particular subject. This effects the web tension and print quality, i.e., enlargement of halftone dots, circumferential doubling, circumferential register errors, etc. . . . , in a negative manner. Optimum angular contact which meets the technical printing requirements and the requirements for a stable web path is achieved by inclining the transfer cylinders at an angle in the range as specified above.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENT

The present invention will now be described in more detail with reference to FIG. 1.

Figure 1:
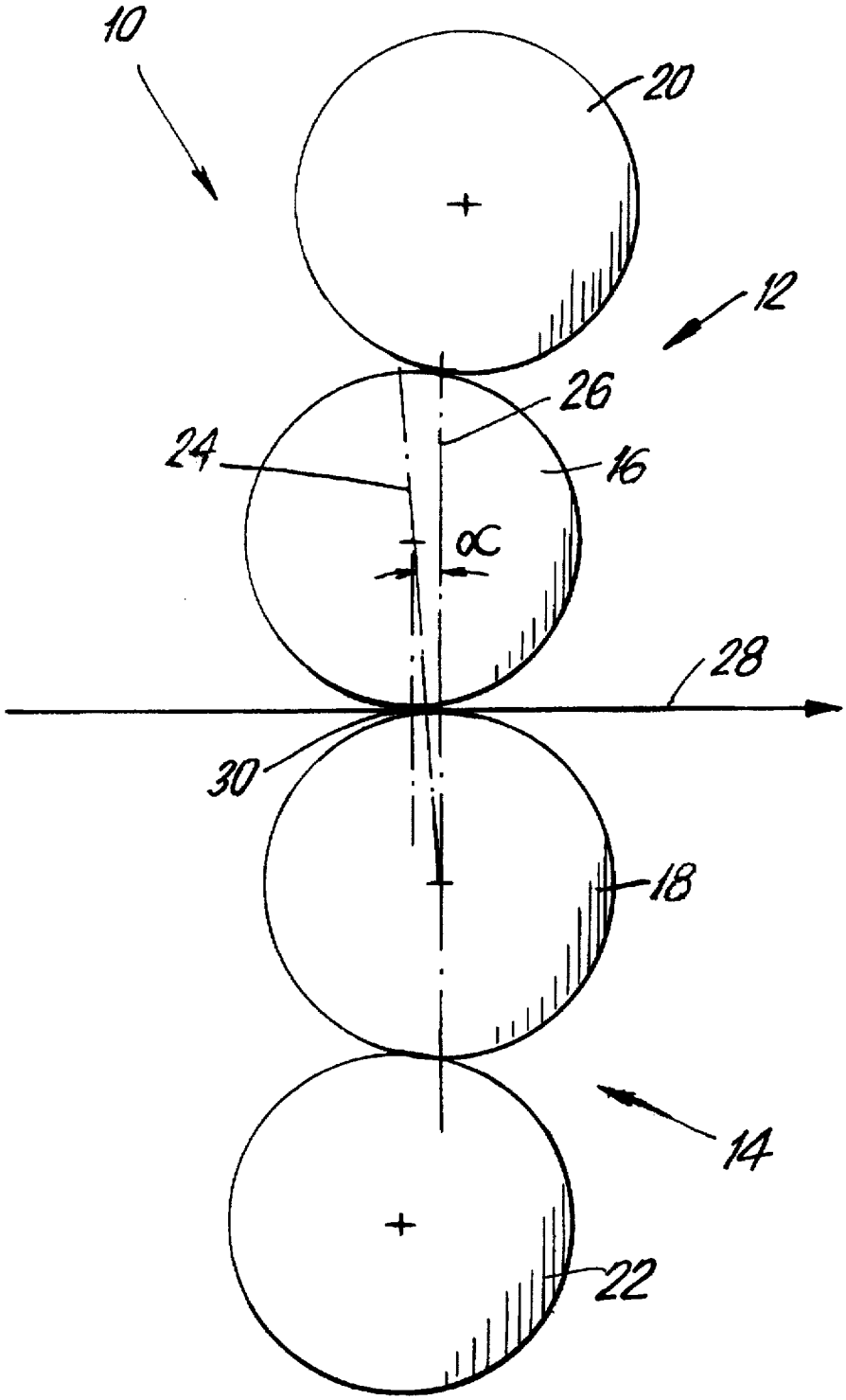
FIG. 1 is a schematic side view of two priming couples aligned one on top of the other in accordance with the present invention.

The printing unit 10 of the present invention is shown schematically in side view in FIG. 1. The printing unit 10 includes first and second printing couples 12, 14. Each printing couple 12, 14 respectively includes a transfer cylinder 16, 18 and a form cylinder 20, 22. The transfer cylinders 16, 18 are arranged one above the other. The transfer cylinders 16, 18 work together and form a line of contact with one another. As used, the term "line of contact" is intended to include a line or a relatively narrow band of contact resulting from the yielding of the transfer cylinders 16, 18 due to their engagement. A web 28 passes between the transfer cylinders 16, 18. A plane 24 extending between the center or axis of each of the transfer cylinders 16, 18 is at an angle $\alpha$ to the vertical 26 substantially perpendicular to the web 28 and passing through the center of one of the cylinders 16 or 18. The contact point 30 between the transfer cylinders 16, 18 is therefore displaced from the vertical 26 in a direction opposite to the direction of travel of the web 28 between the transfer cylinders 16, 18.

Figure 5:
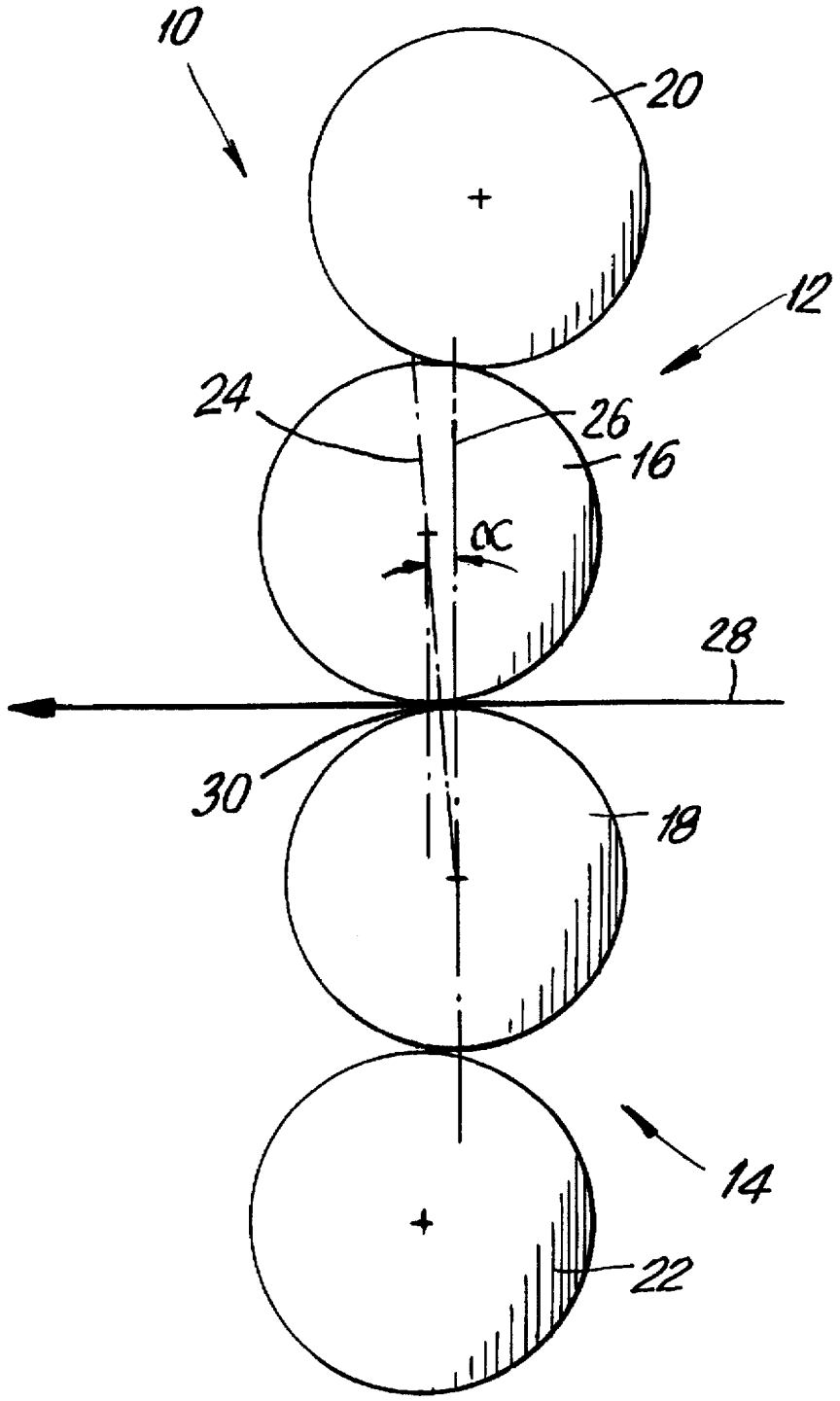
FIG. 5 is a view similar to FIG. 1 of a different embodiment of the invention.

Specifically, the plane 24 extending through the center of each of the transfer cylinders 16, 18 is preferably inclined from the vertical 26 by an angle α of about 5°. However, the angle α may be selected at any angle in a range of from 0° to 10°. The angle α may lie on either side of the vertical 26. In other words, the plane 24 connecting the center of each of the transfer cylinders 16, 18 may be inclined in the direction of travel of the web 28 FIG. 5 inclined against the direction of travel of the web 28 FIG. 1. FIG. 1 shows an angle α and the plane 24 connecting the centers of the transfer cylinders lying on a side of the vertical 26 against the direction of travel of the web. The side of the vertical 26 on which the angle α lies depends upon whether the vertical 26 passes through the center of transfer cylinder 16 or transfer cylinder 18.

Figure 2:
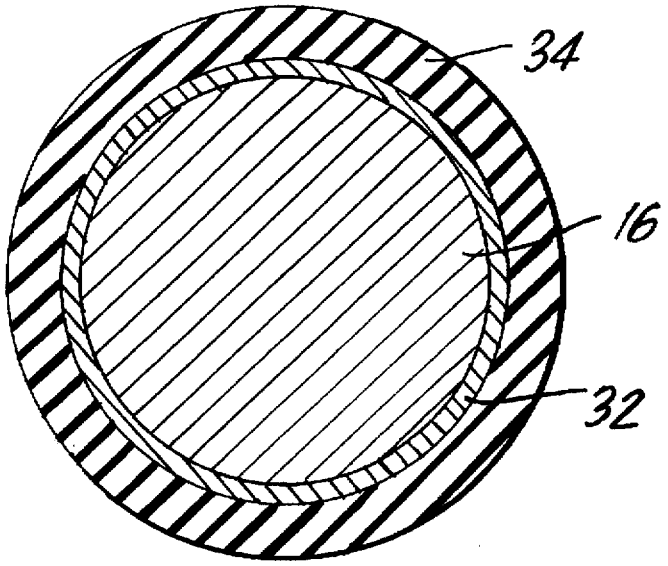
FIG. 2 is a cross-sectional view of a transfer cylinder of the present invention.

The transfer cylinders 16, 18 may both be equipped with a continuous elastomeric blanket 34 as shown in FIG. 2. Blanket 34 can be made of rubber, synthetic rubber, ethylene propylene copolymer or any other suitable elastomeric or yieldable material. This figure shows a cross-section of a transfer cylinder 16. The blanket 34 can be applied as a layer to a support 32 designed as a sleeve. The blanket 34 may also be applied in a gap-free manner on the transfer cylinder 16. The support 32 may also have a plate-type design.

Figure 3:
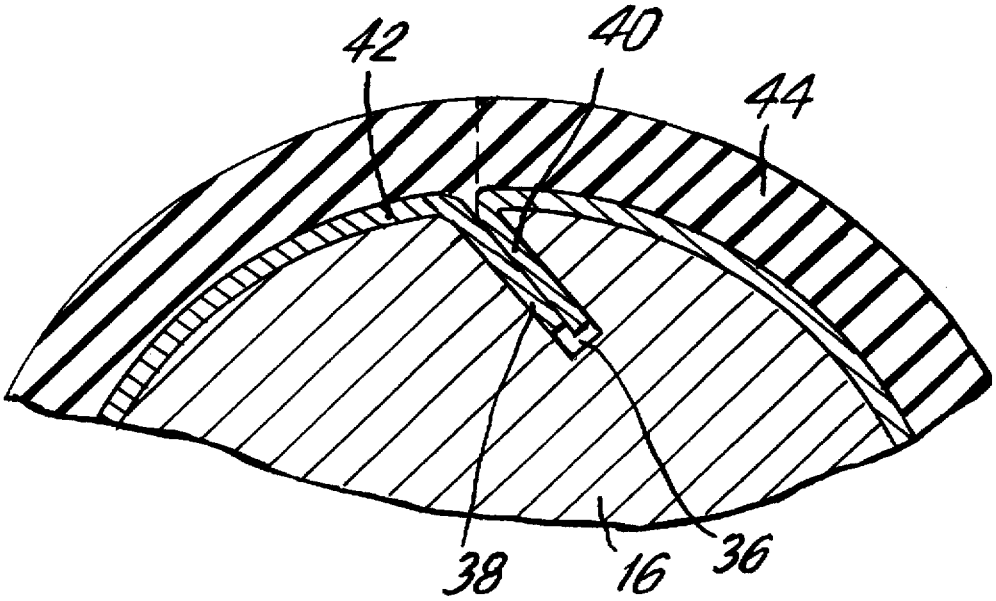
FIG. 3 is a cross-sectional view of an alternate embodiment of a transfer cylinder of the present invention.

A variation on this transfer cylinder 16 is shown in FIG. 3. Here the transfer cylinder 16 has a slot 36. The slot 36 extends in the axial direction and into which bevelled legs 38, 40 of a plate-type support 42 are inserted. A blanket 44 made of elastomeric material like blanket 34 is positioned over the support 42 in a gap-free manner.

Figure 4:
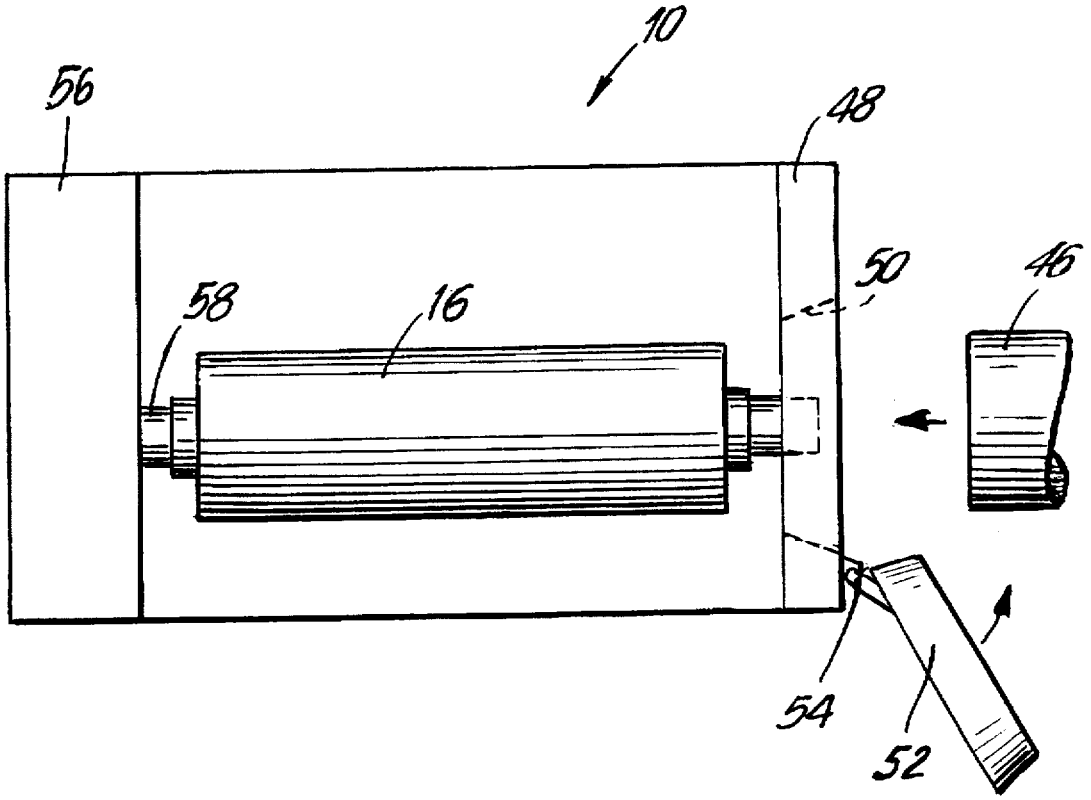
FIG. 4 is a top view of a portion of the printing unit of the present invention having a pivotable bearing on one end thereof.

The present invention may also be designed such that the elastomeric or yieldable blanket sleeve 46, a fragment of which is shown in FIG. 4, may be changed on the cylinder-face side without removing the cylinder 16. This figure illustrates a portion of the printing unit 10. In the side wall 48 of the printing unit 10 there is a pivotable bearing 52 which is able to pivot about a hinge 54. The other end of the cylinder 16 is attached to the opposing side wall 56 using a stationary bearing 58. When it is desired to change the blanket sleeve 46, the pivotable bearing 52 is pivoted away, thus disengaging it, from the side wall 48. This provides an opening 50 for changing the sleeve 46. The cylinder 16 is held in suspension during the changing of the sleeve by the bearing 58 in the opposing side wall 56.

In operation, the two printing couples are arranged one on top of the other such that the transfer cylinders of the printing couples are in contact with one another. Passing between the transfer cylinders is a material on which an image is desired to be printed. As the material passes between the transfer cylinders, it contacts both the transfer cylinders allowing an image to be printed on both sides of the material. The path of the material is along a substantially horizontal plane with respect to the printing couples. The transfer cylinders are positioned so as to be inclined by an angle between 0° and 10° from the vertical. The inclining of the transfer cylinders in this manner produces certain improvements which are not found in prior printing units. Such improvements include a reduction in movement between the web and the cylinder surface and preventing adherence of the web to the printing surface having a larger printing share of the subject at the moment after leaving the printing gap.

The invention is not limited by the embodiments described above which are presented as examples only but can be modified in various ways within the scope of protection defined by the appended patent claims.

What is claimed:

1. A printing unit for blanket-to-blanket printing on a traveling substantially horizontal web, the printing unit comprising upper and lower printing couples each including a transfer cylinder, a seamless elastomeric blanket positioned around a respective one of said transfer cylinders, and a form cylinder; the upper printing couple being positioned above the lower printing couple with the transfer cylinder of the upper printing couple forming a line of contact with the transfer cylinder of the lower printing couple, the web passing through the line of contact, a plane connecting the centers of said two transfer cylinders being inclined relative to the vertical by an angle (α) of up to 10°.

2. The printing unit as claimed in claim 1, wherein the plane connecting the centers of the two transfer cylinders is inclined away from the vertical in the direction of travel of the web.

3. The printing unit as claimed in claim 1, wherein the plane connecting the centers of the two transfer cylinders is inclined away from the vertical in a direction opposite the direction of travel of web.

4. The printing unit as claimed in claim 1, further comprising a support for said blanket, and wherein said blanket is applied to said support as a layer.

5. The printing unit as claimed in claim 1, further comprising a support for said blanket, and wherein said blanket is glued to said support in a gap-free manner.

6. The printing unit as claimed in claim 1, wherein the transfer cylinder has a cylinder face side and further comprising means for removing said blanket from the face side of its respective transfer cylinder without removing said transfer cylinder from the printing unit.

7. The printing unit as claimed in claim 1, wherein said angle (α) is about 5°.

* * * * *